US010335968B2

(12) United States Patent
Ren et al.

(10) Patent No.: US 10,335,968 B2
(45) Date of Patent: Jul. 2, 2019

(54) RAZOR HEAD

(71) Applicant: Xiangrong Ren, Wenzhou (CN)

(72) Inventors: Chi Ren, Wenzhou (CN); Xiangrong Ren, Wenzhou (CN)

(73) Assignee: XIANGRONG REN, Wenzhou (CN)

( * ) Notice: Subject to any disclaimer, the term of this patent is extended or adjusted under 35 U.S.C. 154(b) by 0 days.

(21) Appl. No.: 15/572,743

(22) PCT Filed: Jul. 31, 2015

(86) PCT No.: PCT/CN2015/085685
§ 371 (c)(1),
(2) Date: Nov. 8, 2017

(87) PCT Pub. No.: WO2017/020158
PCT Pub. Date: Feb. 9, 2017

(65) Prior Publication Data

US 2018/0147739 A1 May 31, 2018

(51) Int. Cl.

| | |
|---|---|
| ***B26B 21/00*** | (2006.01) |
| ***B26B 21/40*** | (2006.01) |
| ***B26B 21/22*** | (2006.01) |
| ***B26B 21/44*** | (2006.01) |

(52) U.S. Cl.
CPC ..... *B26B 21/4012* (2013.01); *B26B 21/225* (2013.01); *B26B 21/4025* (2013.01); *B26B 21/4043* (2013.01); *B26B 21/443* (2013.01)

(58) Field of Classification Search
CPC ... B26B 19/40; B26B 21/4012; B26B 21/225; B26B 21/40; B26B 21/4043; B26B 21/443
See application file for complete search history.

(56) References Cited

U.S. PATENT DOCUMENTS

| | | | | |
|---|---|---|---|---|
| 2012/0159787 | A1* | 6/2012 | Luxton | B26B 21/225 30/50 |
| 2014/0109409 | A1* | 4/2014 | Fathallah | B26B 21/4018 30/50 |
| 2016/0207210 | A1* | 7/2016 | Ren | B26B 21/4012 |
| 2016/0354940 | A1* | 12/2016 | Bozikis | B26B 21/227 |
| 2017/0057106 | A1* | 3/2017 | Worrick, III | B26B 21/222 |

* cited by examiner

*Primary Examiner* — Omar Flores Sanchez
(74) *Attorney, Agent, or Firm* — Shimokaji IP

(57) ABSTRACT

A razor head includes a head frame, a razor blade, an independent trimming unit and a lubricating strip. The head frame has a front frame wall, a rear frame wall and a side frame wall. The razor blade is arranged between the front frame wall and the rear frame wall, and assembled on the side frame wall. The trimming unit is assembled on the side frame wall, with a receiving groove being defined by the trimming unit and the rear frame wall. The lubricating strip is inserted into the receiving groove, and clamped by the trimming unit and the rear frame wall. By this token, the trimming unit not only has trimming function, but also has holding function for fixing the lubricating strip, accordingly, the manufacturing process is simplified, the manufacturing materials and manufacturing cost are reduced.

9 Claims, 8 Drawing Sheets

RAZOR HEAD

FIELD OF THE INVENTION

The present invention relates to technical field of shaving, and more particularly to a razor head, its assembly is simple and convenient, and the manufacturing material and manufacturing cost are reduced.

BACKGROUND OF THE INVENTION

With improvement of the economy and the society, abounding consumables are offered to people to satisfy people's demand, thereby improving people's standard or living. While razors are one of these consumables.

Currently, the razors have two types including electric razors and manual razors. Regarding the manual razors, as it has advantages of clean shave and no power source, so, takes up a large percentage of the market share.

Regarding the manual razors having trimming unit, the razor head thereof includes a head frame, razor blades, a trimming unit, a guide roller, a lubricating strip and so on. Wherein, the head frame includes a front frame wall, a rear frame wall, and two side frame walls connecting the front frame wall and the rear frame wall. The razor blades are located between the front frame wall and the rear frame wall and assembled in the side frame walls. The guide roller is assembled on the front frame wall, and the lubricating strip is embedded in the rear frame wall. Further, the trimming unit is also assembled on the rear frame wall, the trimming unit and the lubricating strip assembled are separated by one portion of the rear frame wall, and the lubricating strip is disposed between the razor blade and the trimming unit, so that the rear frame wall is configured to provide two structures for fixing the lubricating strip and the trimming unit respectively.

Since the rear frame wall is configured to provide two separate structures for fixing the lubricating strip and the trimming unit respectively, so the manufacturing technology, the manufacturing materials and the manufacturing costs are increased.

Thus, there is a need for providing a razor head being capable of simplifying manufacturing process and reducing manufacturing materials and cost to overcome the above-mentioned drawbacks.

SUMMARY OF THE INVENTION

One objective of the present invention is to provide a razor head which can simplify manufacturing process and reduce manufacturing materials and manufacturing cost.

To achieve the above-mentioned objectives, a razor head of the present invention includes a head frame, a razor blade, an independent trimming unit and a lubricating strip. The head frame has a front frame wall, a rear frame wall and a side frame wall, the front frame wall and the rear frame wall are arranged in a lengthwise direction of the head frame, with a determined spacing, and integrated together by means of the side frame wall. The razor blade is arranged along a lengthwise direction of the head frame and between the front frame wall and the rear frame wall, and adapted to assemble on the side frame wall, with a cutting edge of the razor blade facing the front frame wall. The trimming unit is arranged along the lengthwise direction of the head frame and adapted to assemble on the side frame wall, with a receiving groove being defined by the trimming unit and the rear frame wall and arranged along the lengthwise direction of the head frame. The lubricating strip is arranged along the lengthwise direction of the head frame and inserted into the receiving groove, and the lubricating strip being clamped by the trimming unit and the rear frame wall.

Preferably, the head frame further comprises a middle frame wall connected between the front frame wall and the rear frame wall and located at a side opposite to skin, and an arc-shaped protrusion is extended from the middle frame wall and arranged along the side frame wall to match with a handle, and an arc-shaped groove is provided on the arc-shaped protrusion; the handle is slid in the arc-shaped groove so that the head frame pivots relative to the handle, and a center line of the arc-shaped groove is arranged along the lengthwise direction of the head frame.

Preferably, a receiving cavity is defined by the front frame wall, the rear frame wall and the side frame wall to accommodate the razor blade, a resilient leg is extended from the side frame wall and toward the receiving cavity, and the razor blade is limited by the resilient leg once the razor blade moves along a first direction and is assembled on the resilient leg.

Preferably, the rear frame wall comprises a separating plate for defining the receiving cavity and arranged along the lengthwise direction of the head frame; the trimming unit comprises a supporting plate and a trimming blade connected to the supporting plate, the supporting plate is faced to the skin, the trimming blade is away from to the skin; ends of the supporting plate and the trimming blade are inserted into the side frame wall along the first direction and surrounded by the side frame wall, and the supporting plate and the separating plate are arranged side by side to define the receiving groove.

Preferably, a through hole communicated with the receiving cavity is opened in the separating plate, the through hole is arranged along the lengthwise direction of the head frame, the rear frame wall further comprises a connecting plate which is away from the skin, a first end of the connecting plate is connected to the separating plate, a second end of the connecting plate is extended to the supporting plate, a bearing portion is extended from the supporting plate and to the receiving groove, and the lubricating strip in the receiving groove is carried by the bearing portion.

Preferably, a through slot is opened between the front frame wall and the rear frame wall, a clamping piece is provided on the side frame wall and comprises a pressing section across the razor blade and an insertion section bent from the pressing section and inserted into the through slot along the first direction, a separation notch is provided on the insertion section and extended through an end of the insertion section along the first direction to form an expansion portion which is expanded toward inner walls of the through slot, the pressing section is stretched by means of the expansion portion, the insertion section is prevented from being drawn from the through slot along an opposite direction of the first direction due to the expansion portion, the pressing section is pushed against the razor blade, and the razor blade is clamped between the pressing section and the side frame wall.

Preferably, after the insertion section is inserted in the through slot, an external tool is inserted into the separation notch along the opposite direction of the first direction to extrude and expand the expansion portions, so that the expansion portions are pushed against the inner walls of the through slot.

Preferably, the expansion portions have a first expansion portion and a second expansion portion both of which are expanded away from themselves by means of the external tool to cause the first and the second expansion portions to push against the inner walls of the through slot.

Preferably, the through slot is arranged at two sides of the razor blade, and the insertion section is extended from an end of the pressing section, with each insertion section is inserted into each separation notch; one end of the through slot away from the pressing section is expanded to form an expansion hole section which has a wider size than other portions of the through slot, and the first and the second expansion portions are pushed against inner walls of the expansion hole section.

Preferably, the insertion section passes through the trimming unit and then is inserted in to the through slot, and the trimming unit is clamped by the pressing section and the side frame wall.

In comparison with the prior art, since the trimming unit is arranged along the lengthwise direction of the head frame and configured on the two side frame walls, and a receiving groove extended along the lengthwise direction of the head frame is defined by the trimming unit and the rear frame wall. Aft the lubricating strip is inserted in to the receiving groove, the lubricating strip is clamped by the trimming unit and the rear frame wall. That is, the lubricating strip is fixed by the trimming unit and the rear frame wall. By this token, the trimming unit not only has trimming function, but also has fixing function for fixing the lubricating strip. Meanwhile, as for a conventional razor head, because the lubricating strip and the trimming unit need to be assembled in the rear frame wall, so the rear frame wall needs to provide two separate structures for fixing the lubricating strip and the trimming unit respectively. Instead, when the trimming unit of the present invention is assembled in the two side frame walls, the receiving groove is formed accordingly to receive the lubricating strip, thereby simplifying the manufacturing process, and reducing manufacturing materials and manufacturing cost finally.

While when the trimming unit of the present invention is assembled in the side frame wall, a receiving groove for receiving the lubricating strip is formed by the trimming unit and the rear frame wall, thereby simplifying technology and reducing manufacturing cost.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

A distinct and full description of the technical solution of the present invention will follow by combining with the accompanying drawings.

Figure 1:
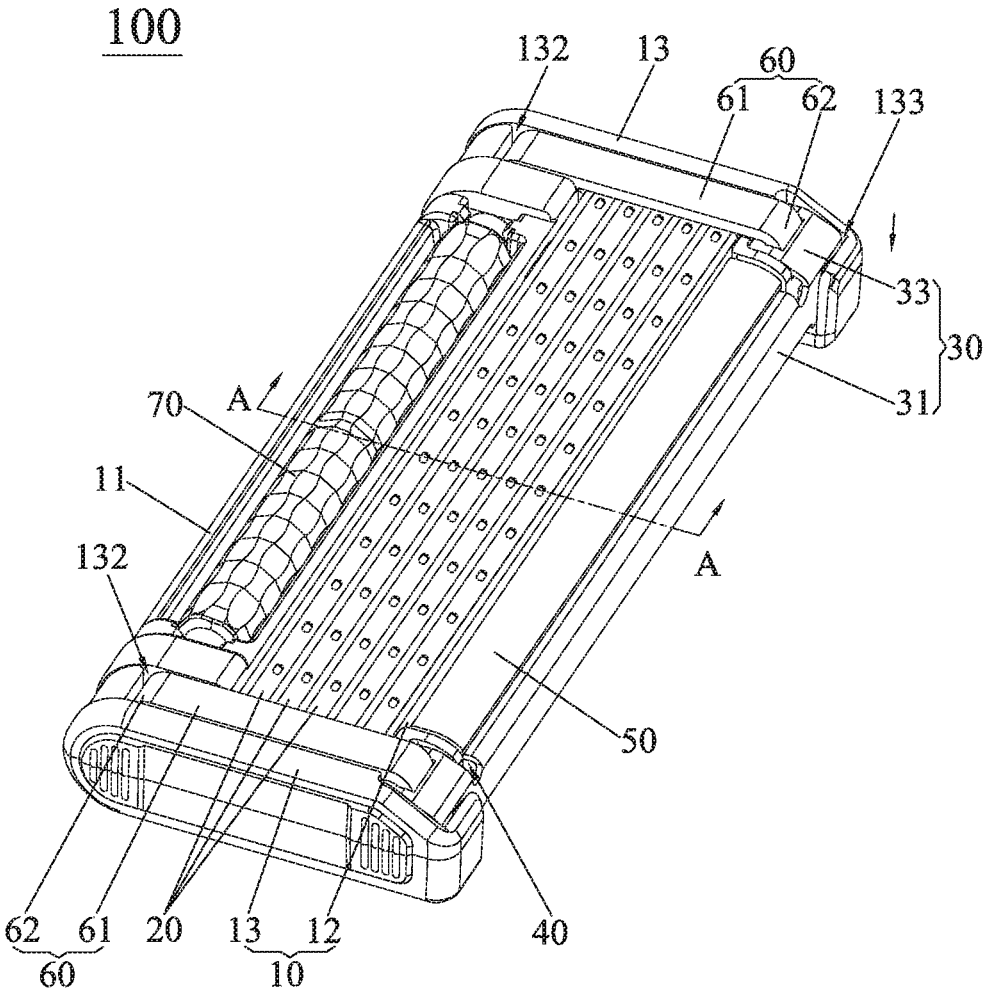
FIG. 1 is a perspective view of a razor head according to a first embodiment of the present invention.
Figure 2:
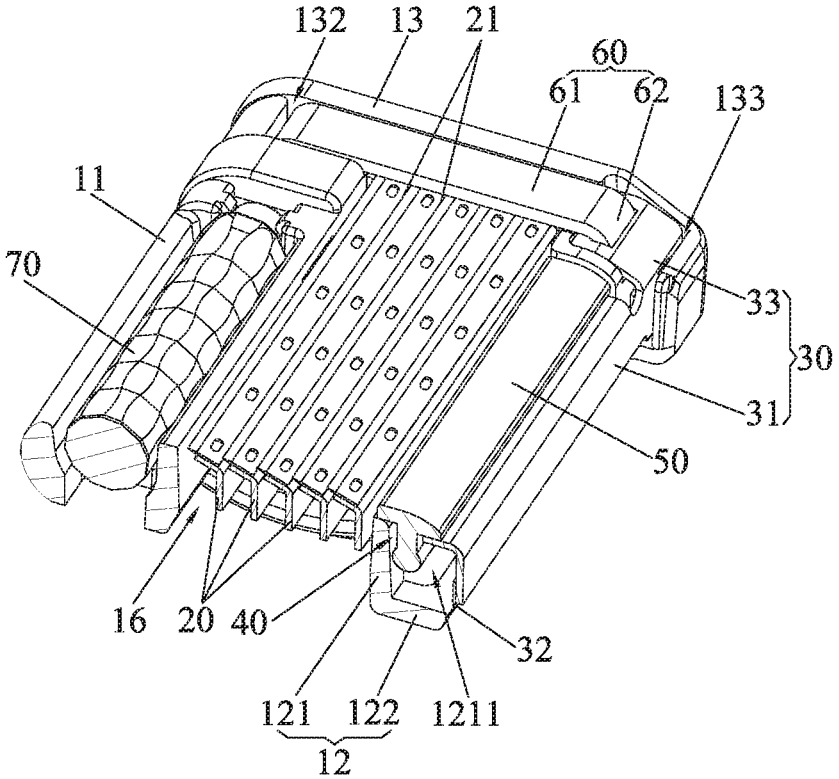
FIG. 2 is a cross-sectional view of the razor head along the A-A line in FIG. 1.

Referring to FIGS. 1-2, the razor head 100 according to the present invention includes a head frame 10, a razor blade 20, an independent trimming unit 30, and a lubricating strip 50. The trimming unit 30 is separate, that is to say, the trimming unit 30 is separated from the razor blade 20 but not directly connected to the razor blade 20, so that the trimming unit 30 and the razor blade 20 are individually assembled in the head frame 10.

Figure 6:
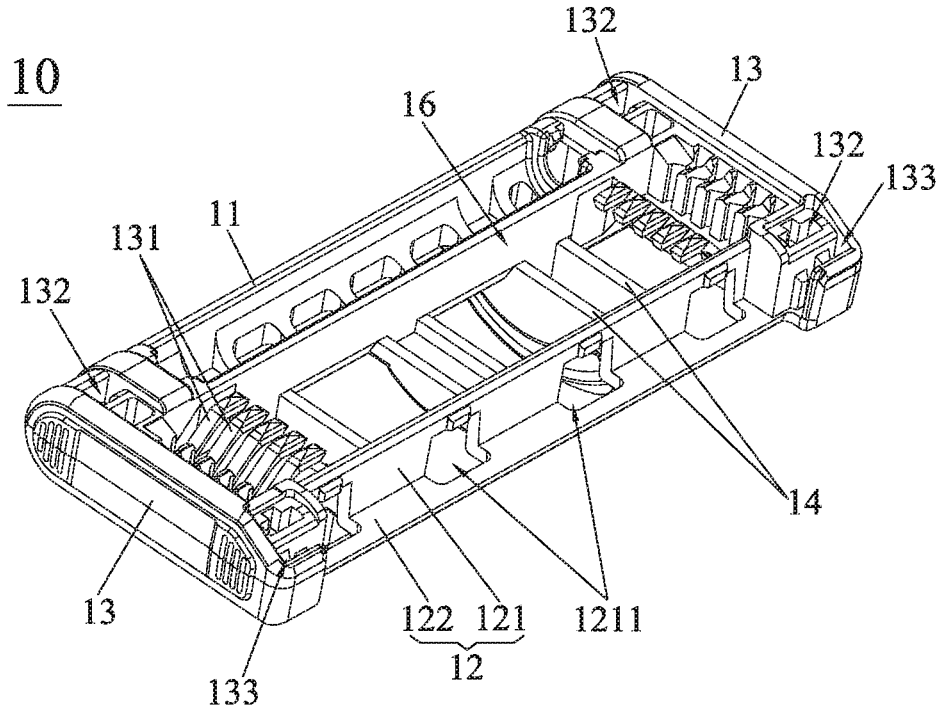
FIG. 6 is a perspective view of a head frame of the razor head according to the present invention.

As shown in FIG. 6, the head frame 10 includes a front frame wall 11, a rear frame wall 12 and two side frame walls 13, the front frame wall 11 and the rear frame wall 12 are arranged along a lengthwise direction of the head frame 10 that is the left and right directions of the head frame 10 in FIG. 6. The front frame wall 11 and the rear frame wall 12 are spaced from each other side by side, that is, the front frame wall 11 and the rear frame wall 12 are spaced from each other along a widthwise direction of the head frame 10 that is the forward or backward direction of the head frame in FIG. 1, so that a space for installing the razor blade 20 is formed. The two side frame walls 13 connect the front frame wall 11 to the rear frame wall 12 to form a frame-like structure in order to simplify the structure of the head frame 10. Preferably, as shown in FIG. 6, the front frame wall 11 and the rear frame wall 12 are parallel to each other, the two side frame walls 13 are parallel to each other, the front frame wall 11 and the rear frame wall 12 are located between the two side frame walls 13, the front frame wall 11, one of the two side frame walls 13, the rear frame wall 12 and the other one of the two side frame walls 13 are connected end to end so as to facilitate the assembly of the razor blades 20, the trimming unit 30 and the lubricating strip 50.

Figure 3:
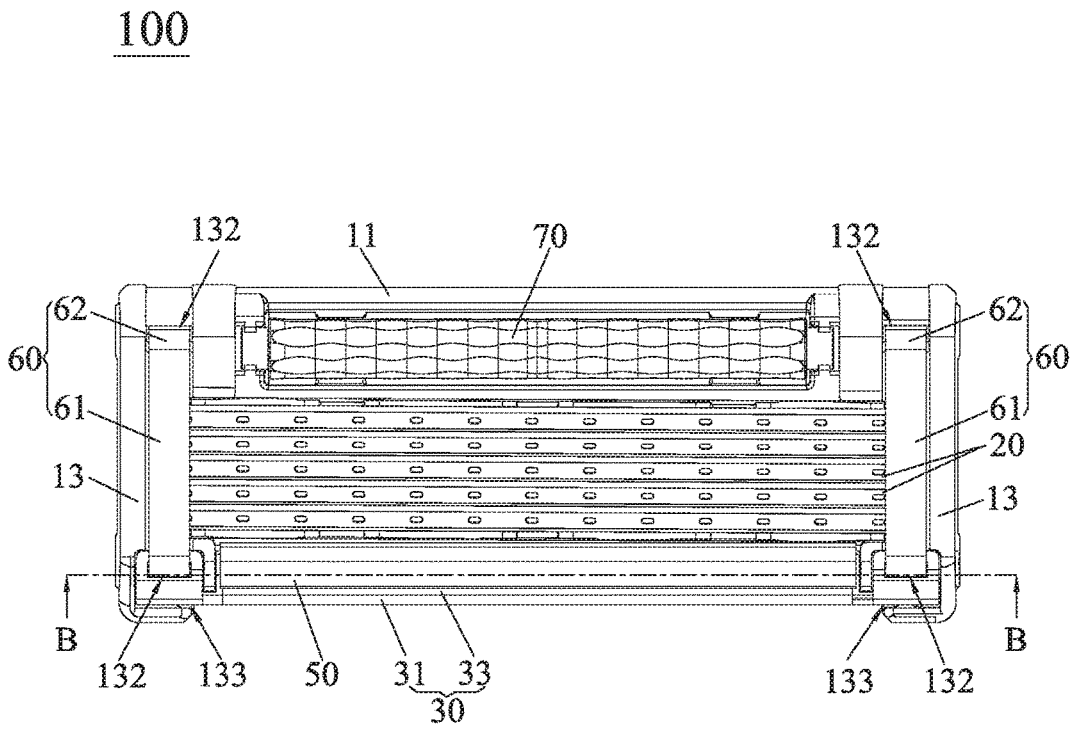
FIG. 3 is a plan view of the razor head shown in FIG. 1.

As shown in FIGS. 1 to 3, the razor blades 20 are located between the front frame wall 11 and the rear frame wall 12 and arranged along the lengthwise direction of the head frame 10, the razor blades 20 are configured on the two side frame walls 13, a cutting edge 21 of the razor blade 20 faces toward the front frame wall 11 to meet the requirements of shaving. Specifically, the front frame wall 11, the rear frame wall 12 and the two side frame walls 13 together define a receiving cavity 16 for receiving the razor blades 20, at least one resilient leg 131 is extended from each of the two side frame walls 13 to the receiving cavity 16, preferably, the number of the resilient legs 131 is same with that of the razor blades 20, so that each razor blade 20 is supported by each resilient leg 131. In the present embodiment, the number of the razor blades 20 is five, of course, in other embodiments, the number of razor blades 20 may be one, two, three or four, etc., which is not so limited. When the razor blade 20 is moved close to the resilient leg 131 along a first direction and then installed on the resilient leg 131, the resilient leg 131 presses against the razor blade 20 along a direction opposite to the first direction to prevent the razor blade 20 from further moving in the first direction. Wherein, a guide roller 70 is configured in the front frame wall 11 to improve shaving effect, the guide roller 70 is arranged in the lengthwise direction of the head frame 10 and preferably parallel to the lubricating strip 50. To be understood, the first direction is from top to bottom of the head frame 10 as shown the arrow in FIG. 1.

As shown in FIGS. 1 to 3, the trimming unit 30 is arranged along the lengthwise direction of the head frame 10 and configured on the two side frame walls 13, and a receiving groove 40 (as shown in FIG. 2) is defined by the trimming unit 30 and the rear frame wall 12 and arrange along the lengthwise direction of the head frame 10. The lubricating strip 50 is arranged along the lengthwise direction of the head frame 10 and inserted into the receiving groove 40, which is clamped by the trimming unit 30 and the rear frame wall 12. Specifically, in this embodiment, the trimming unit 30 and the rear frame wall 12 are arranged in a line, and the lubricating strip 50 has a T-shaped cross section, so that when the lower portion of the lubricating strip 50 is inserted into the receiving groove 40, the lower surface of the top portion of the lubricating strip 50 are pressed against the rear frame wall 12 and the trimming unit 30, thereby the lubricating strip 50 is more stable and reliable. More specifically, as shown in FIGS. 2 and 6, the rear frame wall 12 includes a separating plate 121 used for defining the receiving cavity 16 and arranged along the lengthwise direction of the head frame 10, the trimming unit 30 includes a supporting plate 31 and a trimming blade 32 connected to the supporting plate 31, the supporting plate 31 is faced to the skin (namely the upward direction of the head frame 10 in FIG. 2) while shaving, the trimming blade 32 is away from to the skin (namely the downward direction of the head frame 10 in FIG. 2). Preferably, the trimming blade 32 overlaps the supporting plate 31 partially. The trimming blade 32 is configured on a lower end of the supporting plate 31, so that the razor blades 20 would not interfere with the trimming unit 30 during shaving. Ends of the supporting plate 31 and the trimming blade 32 are inserted into the two side frame walls 13 along the first direction, the two side frame walls 13 cover the ends of the trimming blade 32 and the supporting plate 31, which prevents the cutting edge of the trimming blade 32 from hurting user. An inserting groove 133 is opened in each of the two side frame walls 13 along the first direction to allow the ends of the supporting plate 31 and the trimming blade 32 to be inserted therein, so that the supporting plate 31 and the trimming blade 32 can be assembled in the two side frame walls 13 quickly.

As shown in FIG. 2, the supporting plate 31 and the separating plate 121 are arranged side by side to define the receiving groove 40, and the lubricating strip 50 is stably clamped bye the supporting plate 31 and the separating plate 121. Preferably, the supporting plate 31 and the separating plate 121 are parallel to each other, so that the width of the receiving groove 40 along the lengthwise direction of the head frame 10 is constant. In this embodiment, the supporting plate 31 is located at the rear of the separating plate 121 to reduce the volume of the rear frame wall 12. Preferably, the rear frame wall 12 further includes a connecting plate 122 that is away from the skin, that is, the connecting plate 122 is located below the head frame 10, and a first end of the connecting plate 122 is connected to the separating plate 121. In this embodiment, the connecting plate 122 and the separating plate 121 are formed integrally so as to form the rear frame wall 12, and the cross-section of the connecting plate 122 and the separating plate 121 along the widthwise direction of the head frame 10 is in a "L" shape. The second end of the connecting plate 122 is extended to the supporting plate 31, and a bearing portion 33 is extended from the upper end of the supporting plate 31 to the separating plate 121 and across the receiving groove 40 along a direction opposite to the widthwise direction of the head frame 10. Preferably, the bearing portion 33 is bent and extended from the supporting plate 31 to the separating plate 121. Two bearing portions 33 are respectively extended from two sides of the upper end of the supporting plate 31 and bent to contact with the two side frame walls 13, and a clamping piece 60 (described below) passes through the bearing portion 33 and then fixes the trimming unit 30. The bearing portions 33 are located above the connecting plate 122. A through hole 1211 communicated with the receiving cavity 16 is opened in the rear frame wall 12 to discharge the trimming waste quickly, the through hole 1211 is arranged along the lengthwise direction of the head frame 10. The trimming unit 30 of the supporting plate 31 is made of rigid material, preferably is made of metal, but not limited thereto.

Figure 7:
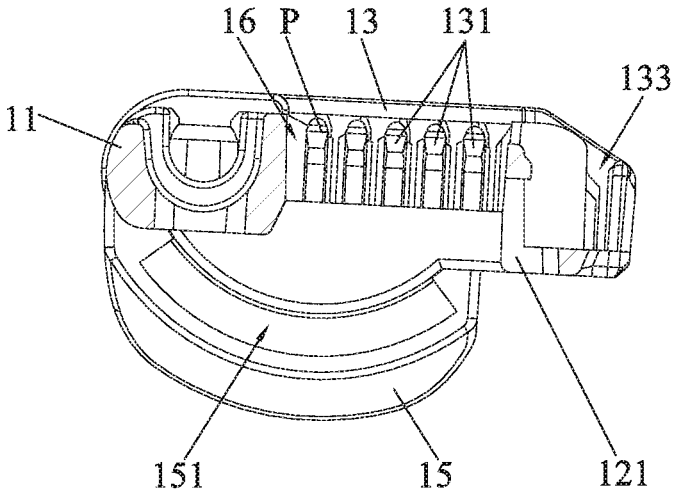
FIG. 7 is a cross-sectional view of the head frame in FIG. 6 along its transverse direction.

As shown in FIGS. 6 and 7, the head frame 10 further includes a middle frame wall 14 connected between the front frame wall 11 and the rear frame wall 12, the middle frame wall 14 is located at a side of the head frame 10 away from the skin (namely the upward direction of the head frame 10 in FIG. 6). An arc-shaped protrusion 15 adapted to be matched with a handle is extended from the middle frame wall 14 along a direction away from the skin, and the arc-shaped protrusion 15 is arranged along a lengthwise direction of the two side frame walls 13. Preferably, the two side frame walls 13 and the arc-shaped protrusion 15 are arranged side by side with determined spacing. An arc-shaped groove 151 is opened in the arc-shaped protrusion 15, the handle is slid in the arc-shaped groove 151 so that the head frame 10 pivots relative to the handle, a center line of the arc-shaped groove 151 is arranged along the lengthwise direction of the head frame 10, and the center line is a line passing through the point P in FIG. 7 and perpendicular to the paper surface of FIG. 7; namely, the head frame 10 pivots relative to the handle around the center line to improve the shaving effects.

Referring to FIGS. 1-5, two through slots 132 are opened in each of the two side frame walls 13, the inserting groove 133 is located at the rear of the two through slots 132. Each of the two side frame walls 13 has a clamping piece 60 configured thereon. The clamping piece 60 is in an inverted "U" shape and includes a pressing section 61 and two inserting sections 62, the pressing section 61 is arranged along the widthwise direction of the head frame 10 and on the razor blade 20, the two inserting sections 62 are respectively bent downward from two ends of the pressing section 61 and inserted into the two through slots 132 along the first direction. A separating notch 621 is opened in each of the two inserting sections 62 and passes through a lower end of the inserting section 62 along the first direction so as to form an expansion portion 63, the expansion portion 63 tenses the pressing section 61 along the first direction Z, the expansion portion 63 is splayed to prevent the two inserting sections 62 from being pulled out from the two through slots 132 along a direction opposite to the first direction, the pressing section 61 contacts with and presses against the razor blades 20, and the razor blades 20 are clamped between the pressing section 61 and the two side frame walls 13. The expansion portion 63 in the through slot 132 is splayed toward an inner wall of the through slot 132 to assist the pressing section 61 to clamp the razor blades 20, thereby simplifying the installing of the clamping piece 60, shortening the length of the clamping piece 60, and reducing the cost of the clamping piece 60.

Figure 4:
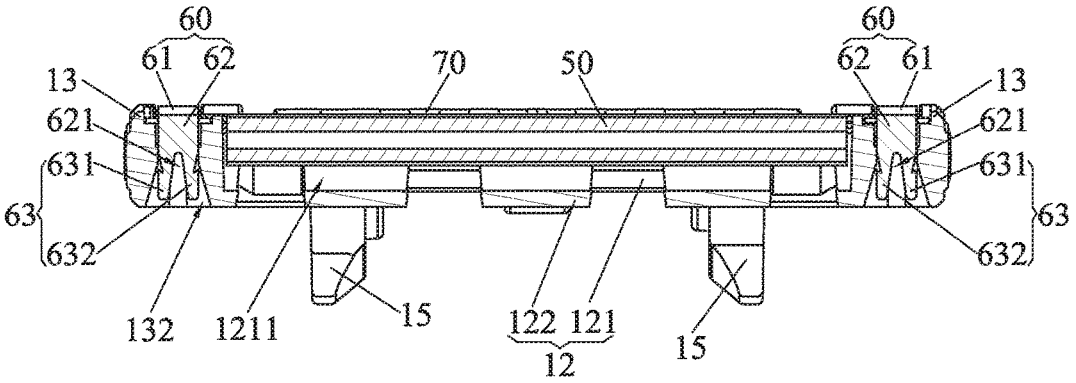
FIG. 4 is a cross-sectional view of the razor head along the B-B line in FIG. 3.

Specifically, as shown in FIG. 4, after the inserting section 62 has been inserted into the through slot 132 along the first direction, an external tool is pressingly inserted into the separating notch 621 along a direction opposite to the first direction, and then the expansion portion 63 is extruded and expanded by the tool and contacted with the inner wall of the through slot 132, and then the clamping piece 60 is installed on the head frame 10. Concretely, before the inserting section 62 is inserted into the through slot 132, the expansion portion 63 has not been splayed apart and has no plastic deformation, and the size of the expansion portion 63 is smaller than that of an opening of the through slot 132. After the inserting section 62 has been inserted into the through slot 132, the expansion portion 63 is located in the through slot 132, then pressingly inserting the tool into the separating notch 621 along a direction opposite to the first direction, so that the expansion portion 63 is splayed by the tool to produce plastic deformation, namely non-elastic deformation, and then the expansion portion 63 is pushed against the inner wall of the through slot 132 to prevent the two inserting sections 62 from being pulled out from the two through slots 132 along a direction opposite to the first direction.

Figure 5:
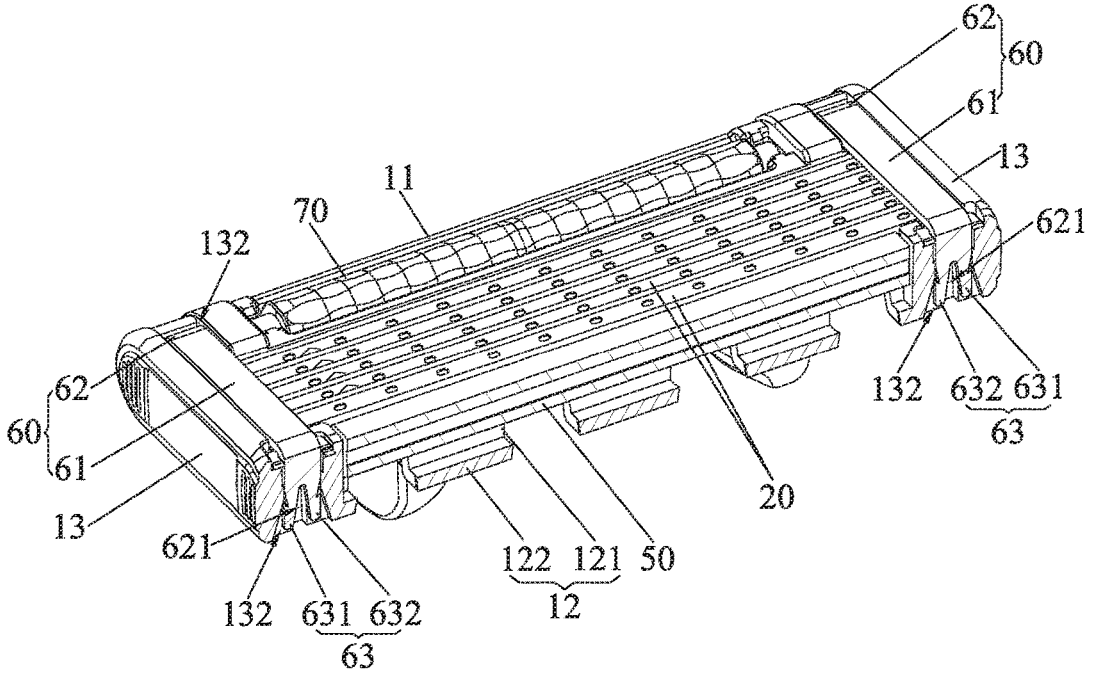
FIG. 5 is perspective view of the razor head along the B-B line in FIG. 3.
Figure 8:
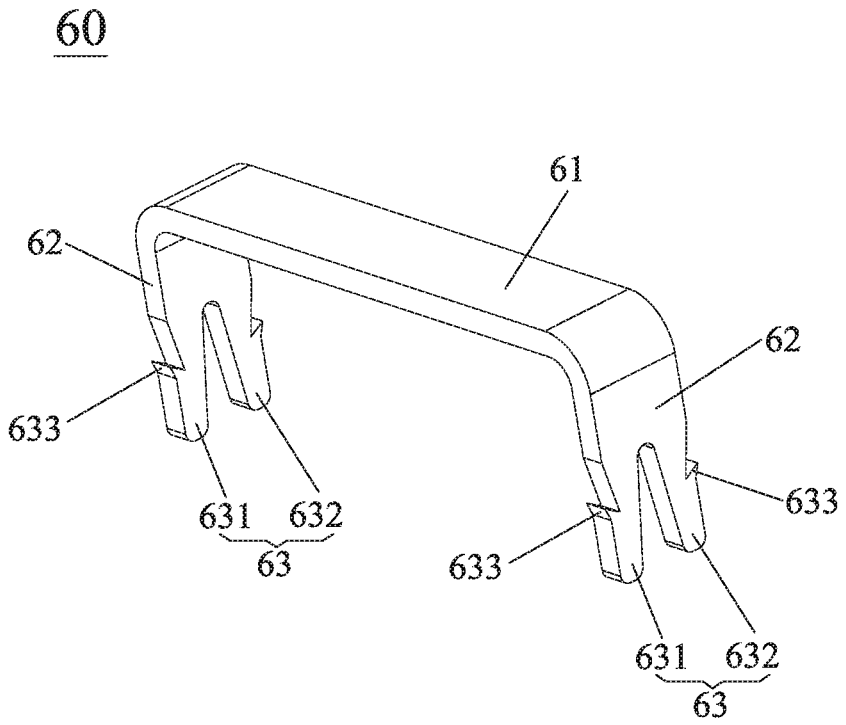
FIG. 8 is a perspective view of a clamping piece of the razor head according to the present invention.

Concretely, as shown in FIGS. 5 and 8, the expansion portion 63 includes a first expansion portion 631 and a second expansion portion 632, the first expansion portion 631 and the second expansion portion 632 are separated from each other by the tool so as to contact with and push against the inner wall of the two through slots 132. As shown in FIG. 3, the through slots 132 are arranged at two sides of the razor blades 20. As shown in FIG. 8, each of the two inserting sections 62 has one separating notch 621, two inserting sections 62 of the clamping piece 60 are respectively inserted in one of the through slots 132 close to the front frame wall 11 and another of the through slot 132 close to the rear frame wall 12, so as to assemble the clamping piece 60 on the head frame 10 quickly. Two barbs 633 are formed respectively on the first expansion portion 631 and the second expansion portion 632, when the first expansion portion 631 and the second expansion portion 632 has been splayed by the tool, the two barbs 633 contact with the inner wall of the through slot 132 and prevent the inserting section 62 from being pulled out. As shown in FIGS. 4 and 5, the cross-section of the through slot 132 along the first direction is in a splayed shape, specifically, one end of the through slot 132 that is far away from the pressing section 61 forms an expansion hole section, and the first expansion portion 631 and the second expansion portion 632 is splayed in the expansion hole section. Wherein, the clamping piece 60 passes through the trimming unit 30 along the first direction and then enters into the two through slots 132, so as to clamp the trimming unit 30 along with the razor blade 20, the trimming unit 30 is clamped by the pressing section 61 and the two side frame walls 13 together. Concretely, the inserting section 62 firstly passes through the supporting plate 31 of the trimming unit 30 and then enters into the through slot 132, preferably, as shown in FIG. 2, the inserting section 62 firstly passes through the bearing portion 33 extended from the supporting plate 31 of the trimming unit 30 and then enters into the through slot 132.

In comparison with the prior art, since the trimming unit 30 is arranged along the lengthwise direction of the head frame 10 and configured on the two side frame walls 13, and a receiving groove 40 extended along the lengthwise direction of the head frame 10 is defined by the trimming unit 30 and the rear frame wall 12. Aft the lubricating strip 50 is inserted in to the receiving groove 40, the lubricating strip 50 is clamped by the trimming unit 30 and the rear frame wall 12. That is, the lubricating strip 50 is fixed by the trimming unit 30 and the rear frame wall 12. By this token, the trimming unit 30 not only has trimming function, but also has fixing function for fixing the lubricating strip 50. Meanwhile, as for a conventional razor head, because the lubricating strip and the trimming unit need to be assembled in the rear frame wall, so the rear frame wall needs to provide two separate structures for fixing the lubricating strip and the trimming unit respectively. Instead, when the trimming unit 30 of the present invention is assembled in the two side frame walls 13, the receiving groove 40 is formed accordingly to receive the lubricating strip 50, thereby simplifying the manufacturing process, and reducing manufacturing materials and manufacturing cost finally.

It should be understood that, as shown in FIG. 4, the inserting sections 62 are inserted and received in the through slot 132, but ends of the insertion sections 62 are not protruded from the through slots 132, which can avoid hurting user. Preferably, the clamping piece 60 is made of aluminum, of course, other materials can also be applied in the present invention, which is well known to persons skilled in the art.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A razor head, comprising:

a head frame having a front frame wall, a rear frame wall and a side frame wall, the front frame wall and the rear frame wall arranged in a lengthwise direction of the head frame, with a determined spacing, and integrated together by means of the side frame wall;

a razor blade arranged along a lengthwise direction of the head frame and between the front frame wall and the rear frame wall, and adapted to assemble on the side frame wall, with a cutting edge of the razor blade facing the front frame wall;

an independent trimming unit arranged along the lengthwise direction of the head frame and adapted to assemble on the side frame wall, with a receiving groove being defined by the trimming unit and the rear frame wall and arranged along the lengthwise direction of the head frame; and a lubricating strip arranged along the lengthwise direction of the head frame and inserted into the receiving groove, and the lubricating strip being clamped by the trimming unit and the rear frame wall;

wherein a receiving cavity is defined by the front frame wall, the rear frame wall and the side frame wall to accommodate the razor blade, a resilient leg is extended from the side frame wall and toward the receiving cavity, and the razor blade is limited by the resilient leg once the razor blade moves along a first direction and is assembled on the resilient leg.

2. The razor head according to claim 1, wherein the head frame further comprises a middle frame wall connected between the front frame wall and the rear frame wall and located at a side opposite to skin, and an arc-shaped protrusion is extended from the middle frame wall and arranged along the side frame wall to match with a handle, and an arc-shaped groove is provided on the arc-shaped protrusion; the handle is slid in the arc-shaped groove so that the head frame pivots relative to the handle, and a center line of the arc-shaped groove is arranged along the lengthwise direction of the head frame.

3. The razor head according to claim 1, wherein the rear frame wall comprises a separating plate for defining the receiving cavity and arranged along the lengthwise direction of the head frame; the trimming unit comprises a supporting plate and a trimming blade connected to the supporting plate, the supporting plate is faced to the skin, the trimming blade is away from to the skin; ends of the supporting plate and the trimming blade are inserted into the side frame wall along the first direction and surrounded by the side frame wall, and the supporting plate and the separating plate are arranged side by side to define the receiving groove.

4. The razor head according to claim 3, wherein a through hole communicated with the receiving cavity is opened in the separating plate, the through hole is arranged along the lengthwise direction of the head frame, the rear frame wall further comprises a connecting plate which is away from the skin, a first end of the connecting plate is connected to the separating plate, a second end of the connecting plate is extended to the supporting plate, a bearing portion is extended from the supporting plate and to the receiving groove, and the lubricating strip in the receiving groove is carried by the bearing portion.

5. The razor head according to claim 1, wherein a through slot is opened between the front frame wall and the rear frame wall, a clamping piece is provided on the side frame wall and comprises a pressing section across the razor blade and an insertion section bent from the pressing section and inserted into the through slot along the first direction, a separation notch is provided on the insertion section and extended through an end of the insertion section along the first direction to form an expansion portion which is expanded toward inner walls of the through slot, the pressing section is stretched by means of the expansion portion, the insertion section is prevented from being drawn from the through slot along an opposite direction of the first direction due to the expansion portion, the pressing section is pushed against the razor blade, and the razor blade is clamped between the pressing section and the side frame wall.

6. The razor head according to claim 5, wherein after the insertion section is inserted in the through slot, an external tool is inserted into the separation notch along the opposite direction of the first direction to extrude and expand the expansion portions, so that the expansion portions are pushed against the inner walls of the through slot.

7. The razor head according to claim 6, wherein the expansion portions have a first expansion portion and a second expansion portion both of which are expanded away from themselves by means of the external tool to cause the first and the second expansion portions to push against the inner walls of the through slot.

8. The razor head according to claim 6, wherein the through slot is arranged at two sides of the razor blade, and the insertion section is extended from an end of the pressing section, with each insertion section is inserted into each separation notch; one end of the through slot away from the pressing section is expanded to form an expansion hole section which has a wider size than other portions of the through slot, and the first and the second expansion portions are pushed against inner walls of the expansion hole section.

9. The razor head according to claim 5, wherein the insertion section passes through the trimming unit and then is inserted in to the through slot, and the trimming unit is clamped by the pressing section and the side frame wall.

* * * * *